US010502103B2

(12) United States Patent
Kurata

(10) Patent No.: US 10,502,103 B2
(45) Date of Patent: Dec. 10, 2019

(54) INTERNAL COMBUSTION ENGINE WITH IMPROVED LUBRICATION SYSTEM

(71) Applicant: HONDA MOTOR CO., LTD., Tokyo (JP)

(72) Inventor: Mashu Kurata, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 121 days.

(21) Appl. No.: 15/825,596

(22) Filed: Nov. 29, 2017

(65) Prior Publication Data

US 2018/0163584 A1 Jun. 14, 2018

(30) Foreign Application Priority Data

Dec. 9, 2016 (JP) ..... 2016239462

(51) Int. Cl.

| | |
|---|---|
| ***F01M 1/04*** | (2006.01) |
| ***F01M 3/00*** | (2006.01) |
| ***F01M 9/06*** | (2006.01) |
| ***F01M 11/02*** | (2006.01) |

(52) U.S. Cl.

CPC ..... *F01M 1/04* (2013.01); *F01M 3/00* (2013.01); *F01M 9/06* (2013.01); *F01M 11/02* (2013.01)

(58) Field of Classification Search

CPC .. F01M 1/04; F01M 1/16; F01M 3/00; F01M 9/06; F01M 9/10; F01M 11/00; F01M 11/02; F01M 2011/022; F01M 2011/023; F16N 7/32; F16N 7/34

See application file for complete search history.

(56) References Cited

U.S. PATENT DOCUMENTS 3,211,255 A * 10/1965 Miyazaki ..... F16N 7/34 184/55.2
3,709,202 A * 1/1973 Brown ..... F02B 1/00 123/518
4,590,897 A * 5/1986 Hundertmark ..... F02M 33/043 123/73 A
5,379,732 A * 1/1995 Mavinahally ..... F01P 1/04 123/73 AA
5,570,662 A * 11/1996 Niemchick ..... F01M 1/04 123/196 CP
5,709,185 A * 1/1998 Aizawa ..... F01M 1/04 123/196 CP (Continued)

FOREIGN PATENT DOCUMENTS

JP 2014020314 A 2/2014

*Primary Examiner* — Grant Moubry
(74) *Attorney, Agent, or Firm* — Armstrong Teasdale LLP

(57) ABSTRACT

An internal combustion engine having an internal space including a crankcase chamber includes an oil tank, a first passage communicating a lower part of the internal space with a gas phase part of the oil tank, a first check valve provided in the first passage to permit a flow from the internal space to the oil tank, a second passage communicating the gas phase part with the internal space, a second check valve provided in the second passage to permit a flow from the second passage to the internal space, a third passage communicating a liquid phase part of the oil tank with the second passage, a third check valve provided in the third passage to permit a flow from the oil tank to the second passage, and a flow regulator valve provided in the third passage for regulating a flow of lubricating oil flowing through the third passage.

8 Claims, 7 Drawing Sheets

(56) References Cited

U.S. PATENT DOCUMENTS

| | | | | |
|---|---|---|---|---|
| 5,948,968 | A * | 9/1999 | Ehlert | F16N 7/32<br>184/6.26 |
| 6,148,807 | A * | 11/2000 | Hazen | F01M 1/04<br>123/572 |
| 6,606,982 | B1 * | 8/2003 | Stockhausen | F01M 13/0011<br>123/572 |
| 6,877,474 | B2 * | 4/2005 | Radel | F01M 3/00<br>123/196 M |
| 8,387,595 | B2 * | 3/2013 | Sugiyama | F01M 1/04<br>123/196 R |
| 8,695,563 | B2 * | 4/2014 | Sugiyama | F16N 7/32<br>123/196 M |
| 8,701,622 | B2 * | 4/2014 | Sugiyama | F01M 1/04<br>123/196 CP |
| 8,707,928 | B2 * | 4/2014 | Sugiyama | F01M 1/04<br>123/196 M |
| 8,978,614 | B2 * | 3/2015 | Takahashi | F01M 1/04<br>123/196 CP |
| 9,022,004 | B2 * | 5/2015 | Hara | F01M 1/04<br>123/196 R |
| 2013/0091816 | A1 * | 4/2013 | Yamazaki | F02M 35/1019<br>55/385.1 |
| 2013/0118440 | A1 * | 5/2013 | Nakamura | F01M 1/04<br>123/196 CP |
| 2014/0209053 | A1 * | 7/2014 | Norrick | F01M 11/061<br>123/196 R |
| 2015/0218979 | A1 * | 8/2015 | Cathcart | F01M 1/02<br>123/294 |

* cited by examiner

E
84A(84)
39
37
5
87A(87)
7
33
34
36
31
32
28
4
1
29
23
18
3
16
50A
19
50
6
45
44
92A(92)
101
50
46
50B
26
22
50C
69
91
61
66A(66)
87A(87)
71B
2F
2D
84A(84)
71A
43
47
20
85
72A(72)
71
2A
2
8
2G
A
up
front
down
rear

INTERNAL COMBUSTION ENGINE WITH IMPROVED LUBRICATION SYSTEM

TECHNICAL FIELD

The present invention relates to an internal combustion engine provided with an improved lubrication system.

BACKGROUND ART

In the field of two stroke engines, it is known to mix lubricating oil in mist form with the intake mixture in order to lubricate various sliding parts of the engine. Mixing lubricating oil with the fuel may be accomplished by mixing the lubricating oil with the liquid fuel which is then injected into the intake air or by spraying oil mist into the intake air separately from the fuel. For instance, JP2014-020314A discloses an arrangement where lubricating oil stored in an oil tank is fed to and injected into an intake passage by using a diaphragm oil pump.

However, the need for an oil pump for supplying lubricating oil inevitably increases the size and complexity of the engine so that the engine may not be commercially acceptable for use as a general purpose engine. Furthermore, when lubricating oil is injected into an intake passage in mist form, the lubricating oil is deposited on the wall surfaces of the intake passage (including the crankcase chamber and the scavenging passage), and stays thereon. When such deposited lubricating oil is sucked into the combustion chamber in any substantial amount, the resulting combustion of the lubricating oil may cause an increase in THC (total hydrocarbon content) in the emission, generation of white smoke and abnormal combustion. Therefore, when the lubricating oil is mixed with the intake in mist form, it is desirable to recover the lubricating oil deposited on the wall surfaces.

SUMMARY OF THE INVENTION

In view of such a problem of the prior art, a primary object of the present invention is to provide an internal combustion engine provided with a lubrication system which allows lubricating oil to be supplied to various parts of the engine, and allows the lubricating oil that may be deposited on the wall surfaces of the engine to be recovered by using a simple structure.

Such an object of the present invention can be accomplished by providing an internal combustion engine, wherein a pressure in an internal space (60) including a crankcase chamber (2A) thereof pulsates owing to a reciprocating movement of a piston in a cylinder, the internal combustion engine comprising: an oil tank (55) separated from the internal space and configured to store lubricating oil therein; a first passage (66) communicating a vertically lower part of the internal space with a gas phase part of the oil tank; a first check valve (69) provided in the first passage to permit a flow from the internal space to the oil tank but not in a reverse direction; a second passage (72) communicating the gas phase part of the oil tank with the internal space; a second check valve (47) provided in the second passage to permit a flow from the second passage to the internal space but not in a reverse direction; a third passage (75) communicating a liquid phase part of the oil tank with the second passage; a third check valve (81) provided in the third passage to permit a flow from the oil tank to the second passage but not in a reverse direction; and a flow regulator valve (82) provided in a part of the third passage located between the third check valve and the second passage for regulating a flow of lubricating oil flowing through the third passage.

Owing to this arrangement, the pressure pulsation of the internal space including the crankcase chamber allows the lubricating oil collected in the lower part of the internal space to be recovered to the oil tank, and the oil stored in the oil tank to be supplied to the internal space in mist form. When the internal space is placed under positive pressure which is higher than the pressure in the liquid phase part of the oil tank, the first check valve is opened so that the lubricating oil collected in the lower part of the internal space and the gas in the internal space are forwarded to the oil tank via the first passage. At the same time, the lubricating oil in the liquid phase part is placed under pressure from the gas phase part, and is fed to the second passage via the third passage. As the lubricating oil is mixed with the gas under pressure at the connecting part between the second passage and the third passage, the lubricating oil is atomized, and oil mist is produced. As the piston moves upward, and the internal space is placed under negative pressure, the second check valve is opened so that the oil mist is fed into the internal space along with the gas. The engine of the present invention is thus able to recover the lubricating oil from the internal space, and return the lubricating oil back to the internal space in mist form by using a simple structure and without requiring a pump.

The internal combustion engine may further comprise a valve actuation chamber (7) accommodating a valve actuation mechanism (34) for actuating an exhaust valve (32) provided in an exhaust passage (31) communicating with the cylinder; a fourth passage (84) communicating a vertically lower part of the internal space with the valve actuation chamber; a fourth check valve (85) provided in the fourth passage to permit a flow from the internal space to the valve actuation chamber but not in a reverse direction; a fifth passage (87) communicating the valve actuating chamber with the internal space or the oil tank; and a fifth check valve (47) provided in the fifth passage to permit a flow from the fifth passage to the internal space or the oil tank but not in a reverse direction.

This arrangement allows the lubricating oil received in a lower part of the internal space to be supplied to the valve actuation chamber by the pulsating pressure of the internal space so that the valve actuation mechanism can be lubricated in a favorable manner.

Preferably, a connecting part between the fourth passage and the internal space is positioned lower than a connecting part between the first passage and the internal space.

Thereby, the lubricating oil received in the internal space can be supplied to the valve actuation chamber preferentially over the oil tank.

Preferably, the internal combustion engine consists of a two stroke engine, and is provided with an intake passage (44) connected with the internal space and a scavenging passage (50) selectively communicating the internal space with a side part of the cylinder depending on a position of the piston; and the second passage and the fifth passage are connected to the internal space via the intake passage, and the second check valve and the fifth check valve consist of a common check valve provided in the intake passage.

According to this arrangement, the oil supplied via the second passage and the fifth passage is mixed with the intake air, and is distributed to various sliding parts of the internal combustion engine. The second check valve and the fifth check valve may consist of a common intake valve configured to control the flow of intake air into the internal space.

The internal combustion engine may include a throttle valve provided upstream of a part of the intake passage where the second passage and the fifth passage are connected thereto.

By making use of the intake negative pressure produced downstream of the throttle valve, the lubricating oil in the second passage in mist form can be favorably transported to the intake passage, and the lubricating oil is prevented from adhering to the throttle valve.

The internal combustion engine may further include a crankshaft disposed in the internal space and rotatably supported by a main body of the internal combustion engine; a sixth passage formed in the main body and extending to a sliding part of the crankshaft; a seventh passage communicating the sixth passage with the fifth passage or with a part of the second passage located between the internal space and a connecting part between the second passage and the third passage; and a sixth check valve provided in the seventh passage to permit a flow to the sixth passage but not in a reverse direction.

Thereby, lubricating oil can be supplied to the sliding parts of the crankshaft in a reliable manner.

The internal combustion engine may comprise a fuel injection valve for injecting fuel into the scavenging passage.

Thereby, the distance from the fuel injection valve to the cylinder is minimized so that the adherence of fuel on the structural members of the crankcase chamber such as the wall is minimized. As a result, the mixing of fuel with the lubricating oil trapped in the bottom part of the crankcase chamber is minimized.

According to yet another aspect of the present invention, the engine consists of a horizontal engine having a cylinder axial line (A) oriented in a substantially horizontal direction.

Thereby, the lubricating oil is favorably put into mist form, and is allowed to reach various sliding parts of the engine carried by the intake so that the lubrication of the sliding parts can be accomplished without regard to the orientation of the engine.

Thus, according to the present invention, the lubrication system of the internal combustion engine allows the lubricating oil to be supplied to various parts of the engine, and allows the lubricating oil that may be deposited on the wall surfaces of the engine to be recovered by using a simple structure.

DETAILED DESCRIPTION OF THE PREFERRED EMBODIMENT(S)

The present invention is described in the following in terms of a preferred embodiment consisting of a single cylinder, uni-flow two stroke engine (engine E) with reference to the appended drawings. In the illustrated embodiment, the engine E is used for powering an electric generator.

Figure 1:
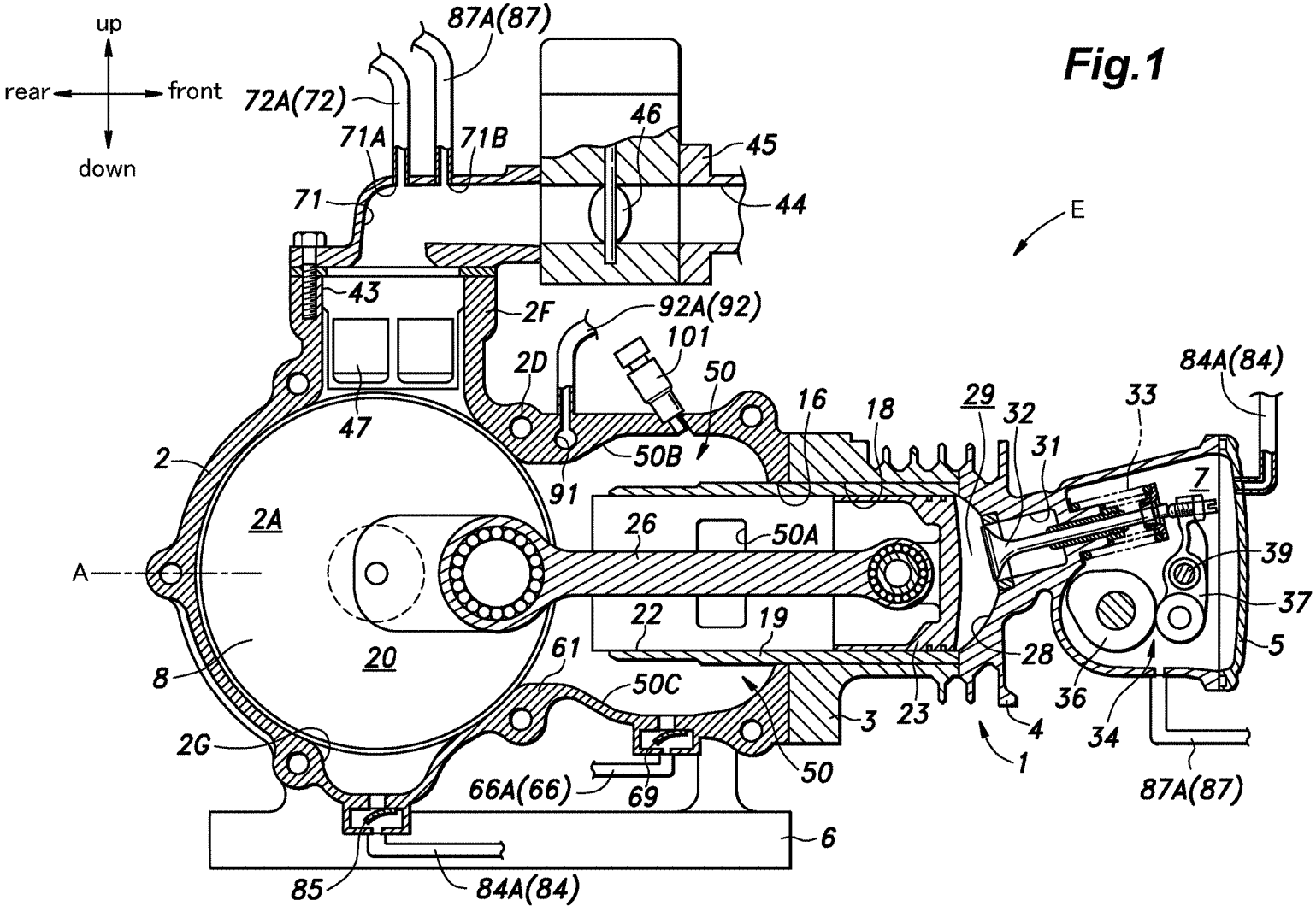
FIG. 1 is a vertical sectional view of a single cylinder, uni-flow two stroke engine embodying the present invention.
Figure 2:
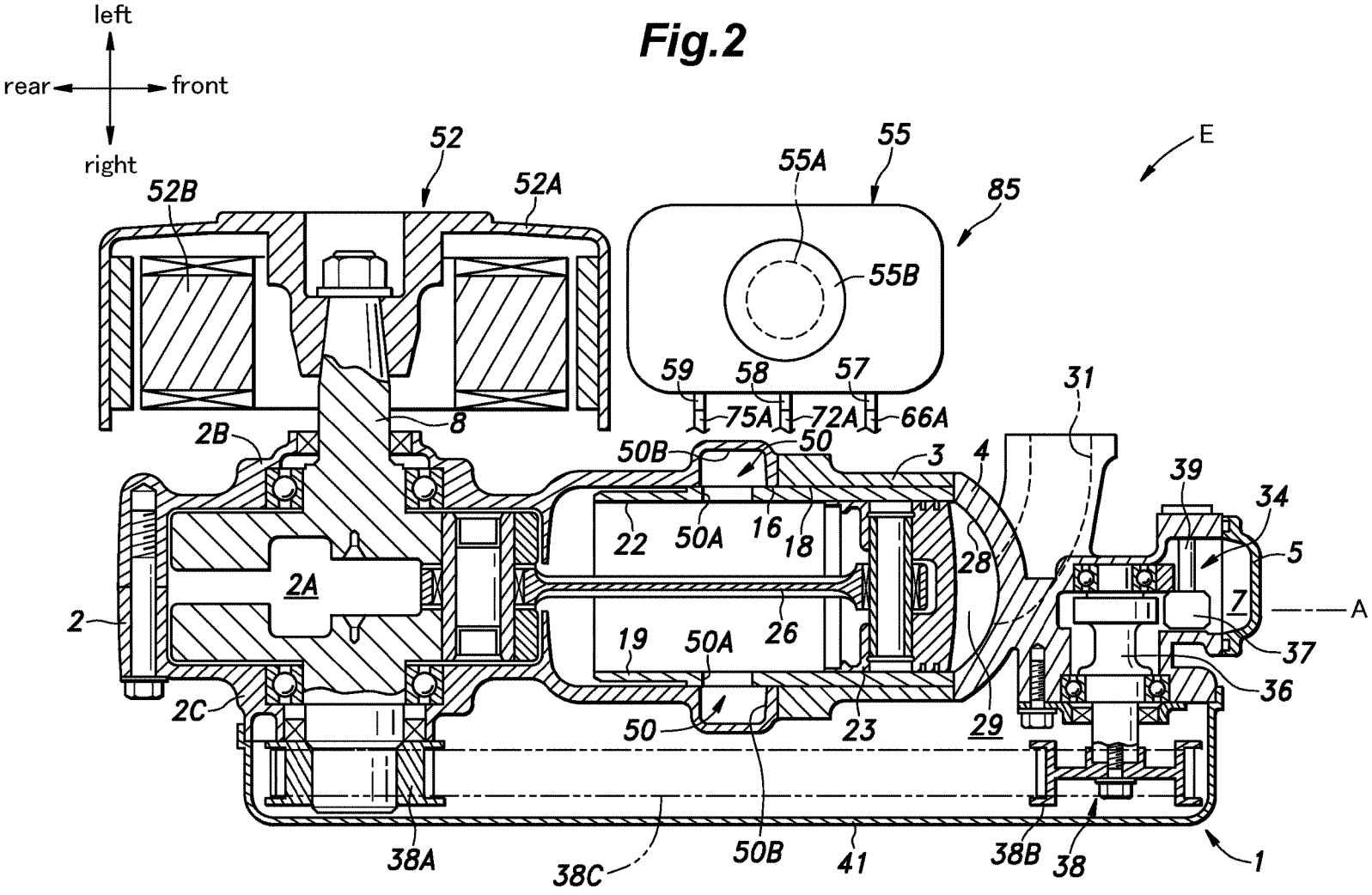
FIG. 2 is a horizontal sectional view taken along line II-II of FIG. 1.

As shown in FIGS. 1 and 2, an engine main body 1 of the engine E includes a crankcase 2 defining a crankcase chamber 2A therein, a cylinder block 3 connected to the front end of the crankcase 2, a cylinder head 4 connected to the front end of the cylinder block 3 and a head cover 5 connected to the front end of the cylinder head 4 and defining a valve actuation chamber 7 in cooperation with the cylinder head 4. The engine main body 1 extends in the fore and aft direction, and is provided with a horizontal cylinder axial line A extending in the fore and aft direction. The lower surface of the crankcase 2 is attached to a base 6 for supporting the engine main body 1 in this horizontal orientation.

The crankcase 2 is formed by a pair of crankcase halves laterally separated from each other by a vertical parting plane (passing through the cylinder axial line A). The crankcase halves are joined to each other by using threaded bolts, and jointly define the crankcase chamber 2A. A crankshaft 8 is rotatably supported by the side walls 2B and 2C of the corresponding crankcase halves via corresponding bearings.

The crankshaft 8 is provided with a pair of journals supported by the side walls 2B and 2C of the crankcase 2, a pair of webs provided between the journals and a crankpin supported between the webs in an eccentrically offset position relative to the journals.

The left end of the crankshaft 8 extends through the left side wall 2B of the crankcase 2, and projects leftward. The right end of the crankshaft 8 extends through the right side wall 2C of the crankcase 2, and projects rightward. A seal member is provided in each part of the crankcase 2 through which the crankshaft 8 is passed.

The front end of the crankcase 2 is provided with a fore and aft extension, and the front end of this extension is formed with a sleeve receiving opening 16 consisting of a circular opening.

The cylinder block 3 extends in the fore and aft direction, and is attached to the front end of the crankcase extension. The cylinder block 3 internally defines a cylinder receiving bore 18 extending over the entire length of the cylinder block 3. When the cylinder block 3 is attached to the crankcase 2, the rear opening of the cylinder receiving bore 18 conformally aligns with the sleeve receiving opening 16 of the crankcase 2 so that a continuous bore is defined jointly by the cylinder receiving bore 18 and the sleeve receiving opening 16.

A cylindrical cylinder sleeve 19 is press fitted into the sleeve receiving opening 16 and the cylinder receiving bore 18. The rear end of the cylinder sleeve 19 projects into the crankcase extension, and the front end of the cylinder sleeve 19 is flush with the front surface of the cylinder block 3, and abuts the opposing surface of the cylinder head 4. The inner bore of the cylinder sleeve 19 defines an engine cylinder 22.

The cylinder 22 slidably receives a piston 23 which is pivotally connected to a small end of a connecting rod 26 via a piston pin extending in parallel with the crankshaft 8. The big end of the connecting rod 26 is pivotally connected to the crankpin via a bearing. The piston 23 is thus connected to the crankshaft 8 via the connecting rod 26 such that the reciprocating movement of the piston 23 is converted into the rotational movement of the crankshaft 8.

In the illustrated embodiment, the cylinder 22 is oriented horizontally so that the piston 23 moves forward to reduce the volume of the combustion chamber 29, and downward to increase the volume of the combustion chamber 29. However, for the convenience of illustration, such a forward movement may be referred to as an upward movement or an upward stroke of the piston 23, and a rearward movement as a downward movement or a downward stroke of the piston 23.

As shown in FIGS. 1 and 2, the rear end surface of the cylinder head 4 is formed with a spherical recess 28 at a position corresponding to the cylinder 22. A combustion chamber 29 is defined by the spherical recess 28, the opposing end surface of the piston 23 and the surrounding wall of the cylinder sleeve 19 in a per se known manner.

In the cylinder head 4 is provided an ignition plug (not shown in the drawings) whose plug tip is exposed to the combustion chamber 29. The cylinder head 4 is further provided with an exhaust port 31 (exhaust passage) opening into the combustion chamber 29 and an exhaust valve 32 consisting of a poppet valve provided in the exhaust port 31. The exhaust valve 32 is provided with a valve stem that extends into the valve actuation chamber 7, and normally closes the exhaust port 31 under the spring force of a valve spring 33. The exhaust valve 32 can be lifted or opened at a prescribed timing in relation with the rotation of the crankshaft 8 via a valve actuation mechanism 34 accommodated in the valve actuation chamber 7.

As shown in FIG. 1, the valve actuation mechanism 34 includes a camshaft 36 and a rocker arm 37. The camshaft 36 extends in parallel with the crankshaft 8 and is rotatably supported by the cylinder head 4. The right end of the camshaft 36 projects out of the cylinder head 4, and is connected to the crankshaft 8 via a power transmission mechanism 38. The power transmission mechanism 38 includes a crank pulley 38A fitted on the right end of the crankshaft 8, a cam pulley 38B fitted on the right end of the camshaft 36 and a timing belt 38C passed around the crank pulley 38A and the cam pulley 38B. The power transmission mechanism 38 causes the camshaft 36 to rotate at the same speed as and in synchronism with the crankshaft 8.

The part of the cylinder head 4 through which the right end of the camshaft 36 extends is provided with a seal member for maintaining the airtightness of the valve actuation chamber 7 which contains a suitable amount of lubricating oil. The lubricating oil in the valve actuation chamber 7 is stirred by the camshaft 36 so that the sliding parts of the camshaft 36 and the rocker arm 37 are lubricated by the splashed lubricating oil. The head cover 5 may be provided with a filler opening for replenishing the lubricating oil although not shown in the drawings.

The rocker arm 37 is pivotally supported by a rocker shaft 39 supported by the cylinder head 4. The rocker shaft 39 extends in parallel with the camshaft 36. An end of the rocker arm 37 engages the stem end of the exhaust valve 32, and the other end of the rocker arm 37 engages a cam lobe of the camshaft 36 so that the exhaust valve 32 is caused to open the exhaust port 31 at a prescribed timing. The exhaust valve 32 opens once for each revolution of the crankshaft 8.

An end cover 41 is attached to the right side of the crankcase 2, the cylinder block 3 and the cylinder head 4. The end cover 41 is secured to the outer surface of the crankcase 2, the cylinder block 3 and the cylinder head 4 along the peripheral part thereof so as to cover the power transmission mechanism 38.

As shown in FIG. 1, an upper wall 2D of the crankcase 2 is formed with a projection 2F projecting upward. The projection 2F internally defines an intake port 43 which communicates with the crankcase chamber 2A at the lower (downstream) end thereof and with the atmosphere at the upper (upstream) end thereof. The upper end of the intake port 43 is connected to the downstream end of an intake pipe 45 which internally defines an intake passage 44. The intake passage 44 is provided with an air inlet (not shown in the drawings), an air cleaner (not shown in the drawings) and a throttle valve 46 in that order from the inlet end thereof. The intake port 43 is provided with an intake valve (second check valve) 47 that permits the gas flow from the intake passage 44 to the crankcase chamber 2A, but prevents the gas flow from the crankcase chamber 2A to the intake passage 44. In the illustrated embodiment, the intake valve 47 consists of a reed valve including a tent-shaped base with a pointed end directed inward and defining through holes therein and reeds attached to the slanted inner sides of the base so as to close the open ends of the through holes. The intake valve 47 is normally closed, but opens when the pressure in the crankcase chamber 2A becomes lower than the pressure in the intake passage 44 by a prescribed amount owing to the upward movement of the piston 23, and the reeds are deflected away from the open ends of the through holes.

A scavenging passage 50 is defined in the crankcase extension to communicate the crankcase chamber 2A with the interior of the cylinder sleeve 19. The scavenging passage 50 includes a scavenging port 50A formed in the cylinder sleeve 19 and a passage section 50B extending from the scavenging port 50A to the crankcase chamber 2A. The passage section 50B is formed in the part of the crankcase extension surrounding the cylinder sleeve 19 in a front part of the crankcase 2. In the illustrated embodiment, the passage section 50B includes two linear sections extending forward from the crankcase chamber 2A one above the other and an annular section connected between the front ends of the two linear sections. The passage section 50B is connected to the scavenging port 50A via this annular section. In the illustrated embodiment, the scavenging port 50A is provided on either lateral side of the cylinder sleeve 19. The fore and aft dimension of the scavenging port 50A is smaller than the fore and aft dimension of the outer circumferential face of the piston 23.

The scavenging port 50A (scavenging passage 50) is closed and opened as the piston 23 reciprocates. In particular, when the piston 23 is located at a position corresponding to the scavenging port 50A, the scavenging passage 50 is closed by the outer peripheral face of the piston 23. When the lower or rear edge of the piston 23 is located above or ahead (the TDC side) of the lower or rear edge of the scavenging port 50A, the scavenging passage 50 communicates with the space (the crankcase chamber 2A) of the cylinder 22 defined under the piston 23. When the upper edge of the piston 23 is located below (the BDC side) the upper edge of the scavenging port 50A, the scavenging passage 50 communicates with the space (combustion chamber 29) of the cylinder 22 defined above the piston 23.

An AC generator 52 is provided on the left side of the crankcase 2. The left end of the crankshaft 8 is connected to a rotor 52A of the AC generator 52, and a stator 52B is fixedly attached to the crankcase 2 with a suitable fastening arrangement not shown in the drawings. As the crankshaft 8 rotates, the rotor 52A rotates with respect to the stator 52B, and electric power is generated.

An oil tank 55 is provided on the left side of the crankcase 2 and the cylinder block 3 at a position more forward than the AC generator 52. The oil tank 55 stores a prescribed amount of lubricating oil, and the upper part (gas phase part) of the oil tank 55 may contain lubricating oil in mist form. The oil tank 55 has a prescribed vertical dimension, and has a filler opening 55A at a top end of the oil tank 55. The filler opening 55A is normally closed by a cap 55B. A first communication opening 57 and a second communication opening 58 are provided in an upper part of the oil tank 55, and are positioned to be above the level of the lubricating oil stored in the oil tank 55 at all times. A third communication opening 59 is provided in a lower part (liquid phase part) of the oil tank 55 which is located below a minimum level line of the lubricating oil so as to be located below the level of the lubricating oil at all times.

An internal space 60 of the engine E is defined mainly by the crankcase chamber 2A and the scavenging passage 50. The lower end of the internal space 60 is delimited by the lower surfaces of the crankcase chamber 2A and the scavenging passage 50. A hump 61 or an elevated part is formed in a lower part of the crankcase 2 located between a bottom part 50C of the passage section 50B and a bottom part 2G of the crankcase chamber 2A so that the bottom part 50C of the passage section 50B and the bottom part 2G of the crankcase chamber 2A are separated from each other by the hump 61. The bottom part 50C of the passage section 50B is provided with a higher elevation than the bottom part 2G of the crankcase chamber 2A so that the oil that has overflowed from the bottom part 50C of the passage section 50B flows into the bottom part 2G of the crankcase chamber 2A. However, if oil overflows from the bottom part 2G of the crankcase chamber 2A, the oil may flow into the bottom part 50C of the passage section 50B.

Figure 3:
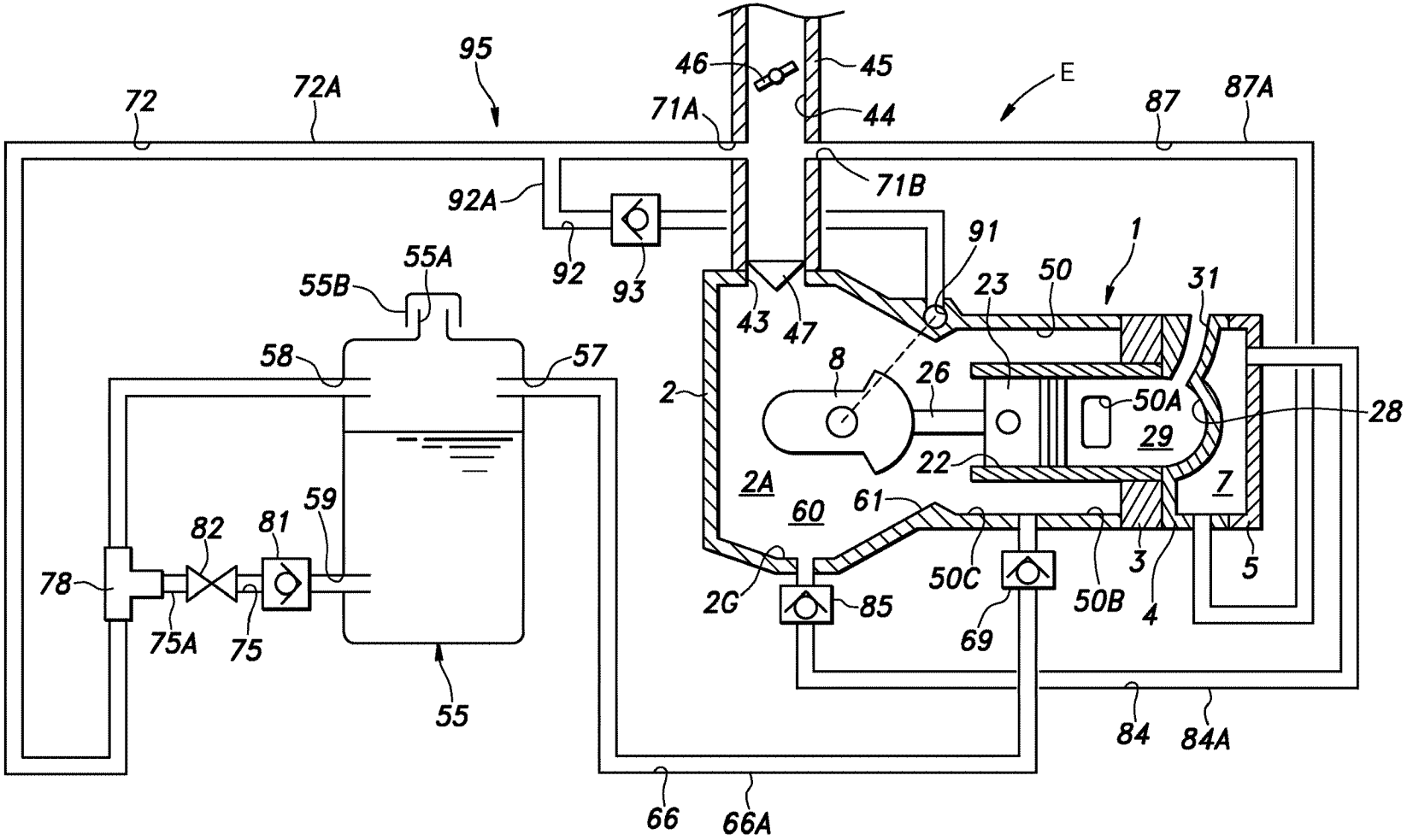
FIG. 3 is a diagram illustrating the structure of the lubrication system.

As shown in FIG. 3, the bottom part 50C of the passage section 50B communicates with the first communication opening 57 of the oil tank 55 via a first passage 66. The first passage 66 may be defined by a separate tube member 66A or a hole in the crankcase 2.

A first check valve 69 is provided in the first passage 66 to permit the flow from the crankcase chamber 2A to the oil tank 55 and to prevent the flow in the opposite direction. The first check valve 69 is normally closed, but opens when the pressure in the crankcase chamber 2A is higher than the pressure in the gas phase part of the oil tank 55 by a prescribed amount. In the illustrated embodiment, the first check valve 69 consists of a reed valve.

A first oil introduction opening 71A and a second oil introduction opening 71B are formed in a part of the intake passage 44 downstream of the throttle valve 46 and upstream of the intake valve 47. The first oil introduction opening 71A and the second oil introduction opening 71B are defined by holes passed through the thickness of the wall of the intake pipe 45. The first oil introduction opening 71A and the second oil introduction opening 71B may consist of tubular members projecting into a central part of the intake passage 44.

The first oil introduction opening 71A is connected to the second communication opening 58 of the oil tank 55 via a second passage 72 defined by a passage forming member 72A such as a pipe member. The second passage 72 is in effect connected to the crankcase chamber 2A via a part of the intake passage 44 downstream of the first oil introduction opening 71A and the intake valve 47. In other words, the part of the intake passage 44 downstream of the first oil introduction opening 71A may also be considered as forming a part of the second passage 72.

The third communication opening 59 formed in the liquid part of the oil tank 55 is connected to an end of a third passage 75 defined by a tube member 75A. The other end of the third passage 75 is connected to a connecting part 78 provided in an intermediate part of the second passage 72. The connecting part 78 may consist of a tee pipe fitting, and connects the third passage 75 to the second passage 72.

An intermediate part of the third passage 75 is provided with a third check valve 81 and a flow regulator valve 82 in that order from the third communication opening 59. The third check valve 81 may consist of a per se known one way valve that permits the flow from the third communication opening 59 to the connecting part 78 but not in the opposite direction. The flow regulator valve 82 may consist of a per se known throttle valve such as a needle valve.

The bottom part 2G of the crankcase chamber 2A and an upper part of the valve actuation chamber 7 are communicated with each other via a fourth passage 84. The fourth passage 84 may be formed by a through hole passed through the crankcase 2 or by a passage member 84A consisting of a pipe member provided on the exterior of the crankcase 2. The fourth passage 84 is provided with a fourth check valve 85 that permits the flow from the crankcase chamber 2A to the valve actuation chamber 7 but not in the opposite direction. The fourth check valve 85 is normally closed, but opens when the pressure in the crankcase chamber 2A is higher than the pressure in the valve actuation chamber 7 by a prescribed amount. In the illustrated embodiment, the fourth check valve 85 consists of a reed valve.

A lower part of the valve actuation chamber 7 and the second oil introduction opening 71B are communicated with each other via a fifth passage 87 formed by a passage member 87A consisting of a pipe member or the like. The fifth passage 87 is connected to the crankcase chamber 2A via a part of the intake passage 44 downstream of the second oil introduction opening 71B and the intake valve 47. In other words, the part of the intake passage 44 downstream of the second oil introduction opening 71B may also be considered as a part of the fifth passage 87. The intake valve 47 consists of a one way valve that permits the flow from the fifth passage 87 and the second passage 72 to the crankcase chamber 2A, but prevents the flow in the opposite direction.

The crankcase 2 is formed with a sixth passage 91 which extends to the bearings of the crankshaft 8, and the sixth passage 91 communicates with a part of the second passage 72 located between the connecting part 78 and the first oil introduction opening 71A via a seventh passage 92 formed by a passage member 92A consisting of a pipe member or the like. The seventh passage 92 is provided with a sixth check valve 93 that permits the flow toward the sixth passage 91, but prevents the flow in the opposite direction.

The first check valve 69, the first passage 66, the oil tank 55, the second passage 72 and the third passage 75 form an essential part of a lubrication system 95 of the engine E. The lubrication system 95 preferably includes the third check valve 81 and the flow regulator valve 82, but these are optional. The lubrication system 95 preferably includes the sixth passage 91, the seventh passage 92 and the sixth check valve 93, but these are also optional.

As shown in FIG. 1, a fuel injection valve 101 is fitted into the upper wall 2D of the crankcase 2. The tip of the fuel injection valve 101 is directed toward the passage section 50B of the scavenging passage 50 so that the fuel injected from the fuel injection valve 101 is injected into the passage section 50B. Preferably, the fuel injection valve 101 injects fuel to a part proximate to the scavenging port 50A of the scavenging passage 50. The fuel injection valve 101 injects fuel into the crankcase chamber 2A at a prescribed timing.

The mode of operation of this engine E is described in the following. As shown in FIG. 1, as the piston 23 moves upward (in an upward stroke of the piston 23), the scavenging passage 50 is closed by the piston 23. At the same time, owing to the expansion of the gas in the crankcase chamber 2A, the pressure in the crankcase chamber 2A drops. This causes the intake valve 47 to open, and fresh air to be introduced into the crankcase chamber 2A via the intake port 43. In the meantime, the mixture in the part of the cylinder 22 above the piston 23 (combustion chamber 29) is compressed by the piston 23. When the piston 23 reaches a point near the TDC (top dead center), the mixture is ignited either by a spark ignition or a compression ignition, and the combustion of the fuel takes place.

Then, the piston 23 moves downward (in a downward stroke of the piston 23), and the resulting contraction of the crankcase chamber 2A causes an increase in the pressure of the crankcase chamber 2A. As a result, the intake valve 47 is closed, and the gas in the crankcase chamber 2A is compressed. As the piston 23 moves further downward, the exhaust valve 32 actuated by the valve actuation mechanism 34 opens. This causes the expanded exhaust gas (combusted gas) to flow into the exhaust port 31 as a blow down flow.

When the piston 23 moves further back until the upper end of the piston 23 is positioned below the upper edge of the scavenging port 50A (or when the scavenging port 50A is opened by the piston 23), the combustion chamber 29 communicates with the scavenging passage 50. By this time, the combusted gas in the combustion chamber 29 has dropped to a level lower than the pressure in the crankcase chamber 2A so that the gas in the crankcase chamber 2A is introduced into the combustion chamber 29 via the scavenging passage 50. At this time point, the fuel injection valve 101 injects fuel into the gas flowing in the scavenging passage 50.

As the piston 23 moves upward once again, the scavenging passage 50 is closed by the piston 23. As the piston 23 moves further upward, the exhaust port 31 is closed by the exhaust valve 32 so that the further upward movement of the piston 23 causes the mixture in the combustion chamber 29 to be compressed. At the same time, the crankcase chamber 2A is depressurized so that the intake valve 47 is opened, and fresh air is drawn into the crankcase chamber 2A via the intake port 43.

The two stroke operation of the engine E is performed in this manner. In particular, this operation is performed as a uni-flow operation because the flow of the scavenging air and the exhaust gas is conducted along a relatively linear path from the scavenging passage 50 to the exhaust port 31 via the cylinder 22.

The mode of operation of the lubrication system 95 is described in the following with reference to FIG. 3. When the engine is stationary, the lubricating oil is mainly stored in the oil tank 55 while a small portion of the lubricating oil remains in the bottom part 2G of the crankcase chamber 2A, the bottom part 50C of the passage section 50B, the valve actuation chamber 7, the fifth passage 87, the sixth passage 91 and the seventh passage 92. When the engine is in operation, and the piston 23 reciprocates, a pressure pulsation occurs in the crankcase chamber 2A. This pressure pulsation is used by the lubrication system 95 as a power source in recovering the lubricating oil trapped in the bottom part 50C of the passage section 50B and the other places, and feeds the lubricating oil to the oil tank 55. The oil in the form of oil mist in the oil tank 55 is forwarded to the intake passage 44. The lubrication system 95 further forwards the lubricating oil in the bottom part 2G of the crankcase chamber 2A to the intake passage 44 via the valve actuation chamber 7 by making use of the pressure pulsation in the crankcase chamber 2A.

During the downward stroke of the piston 23, the volume of the crankcase chamber 2A is reduced so that the pressure in the crankcase chamber 2A rises, and becomes higher than the pressure in the gas phase part of the oil tank 55 and the pressure in the intake passage 44. As a result, the first check valve 69 and the fourth check valve 85 are opened, and the intake valve 47 is closed.

Opening of the first check valve 69 causes the lubricating oil collected in the bottom part 50C of the passage section 50B and the gas within the internal space 60 to be pumped to the gas phase part of the oil tank 55 via the first passage 66. The gas in the crankcase chamber 2A contains lubricating oil and fuel in mist form. The lubricating oil and the gas that are introduced into the gas phase part of the oil tank 55 via the first passage 66 are partly turned into lubricating oil in liquid form under the action of the gravity, and the liquid lubricating oil is fed into the lower liquid phase part of the oil tank 55.

Opening of the first check valve 69 causes the positive pressure of the crankcase chamber 2A to be transmitted to the gas phase part of the oil tank 55 so that the pressure in the gas phase part of the oil tank 55 becomes higher than the pressure in the intake passage 44. As a result, the gas in the gas phase part of the oil tank 55 is supplied to the intake passage 44 via the second passage 72. At this time, the lubricating oil in the liquid phase part of the oil tank 55 is forwarded to the connecting part 78 via the third passage 75 under the pressure of the gas phase part. At the connecting part 78, the gas flowing through the second passage 72 and the liquid lubricating oil flowing through the third passage 75 are mixed with each other so as to produce oil mist.

The oil mist produced at the connecting part 78 is conducted to the intake passage 44 owing to the pressure difference between the gas phase part of the oil tank 55 and the intake passage 44, and is mixed with the intake flowing through the intake passage 44. The intake containing the oil mist is then introduced into the crankcase chamber 2A as the piston 23 moves upward, and the intake valve 47 is opened, and the introduced lubricating oil is used for lubricating the sliding parts of the crankshaft 8, the connecting rod 26, the piston 23 and the cylinder 22. A part of the oil mist contained in the intake is deposited in the sliding parts, and on the wall surfaces of the crankcase 2, the scavenging passage 50 and other engine components, and the remaining part of the lubricating oil is introduced into the combustion chamber 29 along with the intake. The lubricating oil that has deposited on the sliding parts and on the wall surfaces of the crankcase 2 and other engine component parts eventually flows to the bottom part 2G of the crankcase chamber 2A and the bottom part 50C of the passage section 50B under the action of the gravity.

A part of the oil mist flowing through the second passage 72 is directly supplied to the bearings of the crankshaft 8 to lubricate the sliding parts of the crankshaft 8 via the seventh passage 92, the sixth check valve 93 and the sixth passage 91.

The pressure rise in the internal space 60 owing to the downward stroke of the piston 23 causes the fourth check valve 85 to open so that the lubricating oil received in the bottom part 2G of the crankcase chamber 2A and the gas in the internal space 60 are forwarded to the valve actuation chamber 7 under pressure. The lubricating oil flowing through the fourth passage 84 drips onto the valve actuation mechanism 34 from an upper part of the valve actuation chamber 7. The lubricating oil that has lubricated the valve actuation mechanism 34 is collected in a lower part of the valve actuation chamber 7 under the action of the gravity, and is then supplied to the intake passage 44 via the fifth passage 87 under pressure from the internal space 60 supplied to the valve actuation chamber 7 via the fourth passage 84.

The effect of the engine E of the illustrated embodiment is discussed in the following. The lubrication system 95 of the engine E recovers the lubricating oil collected in a lower part of the crankcase chamber 2A to the oil tank 55, and supplies the lubricating oil stored in the oil tank 55 to the intake passage 44 in mist form by making use of the pressure pulsation in the crankcase chamber 2A. When the crankcase chamber 2A is placed under a positive pressure, and the pressure in the crankcase chamber 2A has become higher than the gas phase part of the oil tank 55 owing to the downward stroke of the piston 23, the first check valve 69 is opened, and the lubricating oil in the bottom part 50C of the passage section 50B and the gas in the crankcase chamber 2A are forwarded to the oil tank 55 via the first passage 66. The gas in the gas phase part of the oil tank 55 is pumped to the intake passage 44 via the second passage 72 under the positive pressure of the crankcase chamber 2A. At the same time, the lubricating oil in the liquid phase part of the oil tank 55 is passed to the third passage 75, and then to the connecting part 78 connected to the second passage 72 under the pressure of the gas phase part of the oil tank 55. At the connecting part 78, the lubricating oil is put into mist form owing to the mixing of the lubricating oil with the gas. The lubricating oil in mist form is then fed into the intake passage 44 to be mixed with the intake. Thus, according to the two-stroke engine of the present invention, the lubricating oil can be transported without requiring a pump and by using a simple structure, and the lubricating oil can be mixed into the intake in mist form. By supplying the lubricating oil in liquid form from the third passage 75 to the gas flowing through the second passage 72, the gas and the lubricating oil are mixed with each other so as to form oil mist. Therefore, oil mist can be produced without requiring a mist generator such as an oil slinger that consumes power so that the fuel economy can be improved.

The amount of lubricating oil that is supplied to the connecting part 78 via the third passage 75 can be adjusted by using the flow regulator valve 82. Therefore, by adjusting the flow regulator valve 82, the concentration of lubricating oil in the oil mist and the diameter of the oil droplets in the oil mist can be controlled.

Because the third passage 75 is provided with the third check valve 81, even when the pressure in the intake passage 44 should rise depending on the operating condition of the engine E, the lubricating oil is prevented from flowing back to the third passage 75 (or toward the oil tank 55).

In the illustrated embodiment, because the lubricating oil is put into the form of mist, the lubricating oil is retained in the intake to be distributed to various sliding parts of the engine, and is therefore allowed to reach the respective sliding parts without regard to the orientation of the engine E. For instance, even when the engine E is horizontally placed (with a horizontal cylinder axial line) as is the case with the illustrated embodiment, various sliding parts can be favorably lubricated.

Because the lubricating oil is directly supplied to the sliding parts of the crankshaft 8 via the seventh passage 92 and the sixth passage 91 that branch off from the second passage 72, the crankshaft 8 can be lubricated in a reliable manner.

The valve actuation mechanism 34 is lubricated by the oil supplied via the fourth check valve 85, the fourth passage 84, the valve actuation chamber 7, the fifth passage 87 and the intake passage 44 under the pulsating pressure in the internal space 60. The lubricating oil that has passed through the valve actuation chamber 7 is returned to the internal space 60, instead of the oil tank 55. Therefore, even if water should condense in the valve actuation chamber 7 owing to a relatively low temperature therein, the water condensate is returned to the internal space 60 so that the water condensate is prevented from being deposited in the oil tank 55.

The connecting part (or the first oil introduction opening 71A) between the second passage 72 and the intake passage 44 is provided downstream of the throttle valve 46 and upstream of the intake valve 47 so that the lubricating oil in mist form in the second passage 72 can be transported to the intake passage side by making use of the intake negative pressure produced in the downstream side of the throttle valve 46. Also, this arrangement contributes to the minimization of the adherence of lubricating oil supplied from the second passage 72 onto the throttle valve 46.

Because the fuel injection valve 101 injects fuel into the scavenging passage 50, the distance between the fuel injection valve 101 and the scavenging port 50A is minimized, and this minimizes the adhering of fuel on the structural members defining the crankcase chamber 2A such as the wall surface. This contributes to the minimization of the amount of fuel that may mix into the lubricating oil that is collected in the bottom part 2G of the crankcase chamber 2A.

Figure 4:
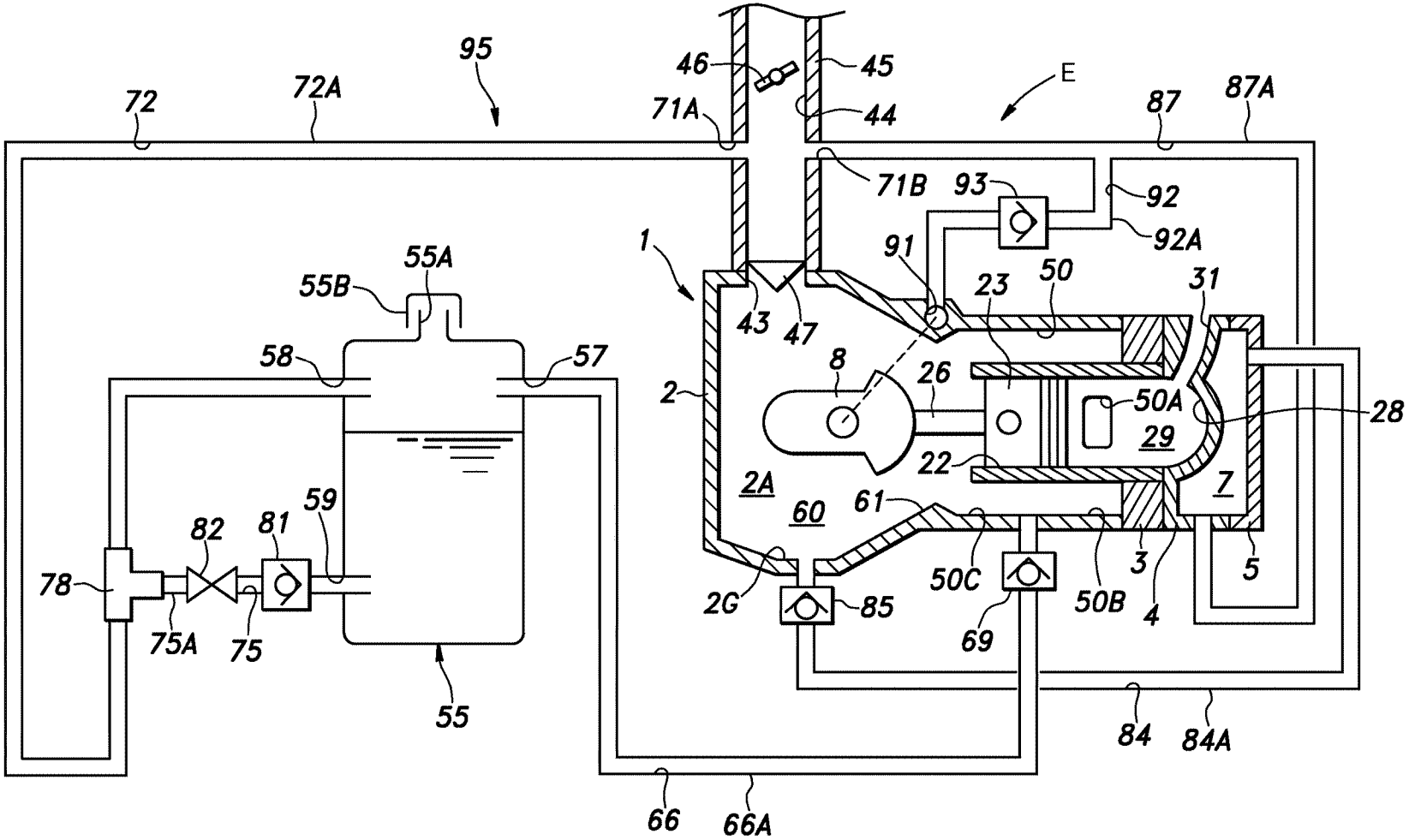
FIG. 4 is a diagram similar to FIG. 3 showing a modified embodiment of the lubrication system.
Figure 5:
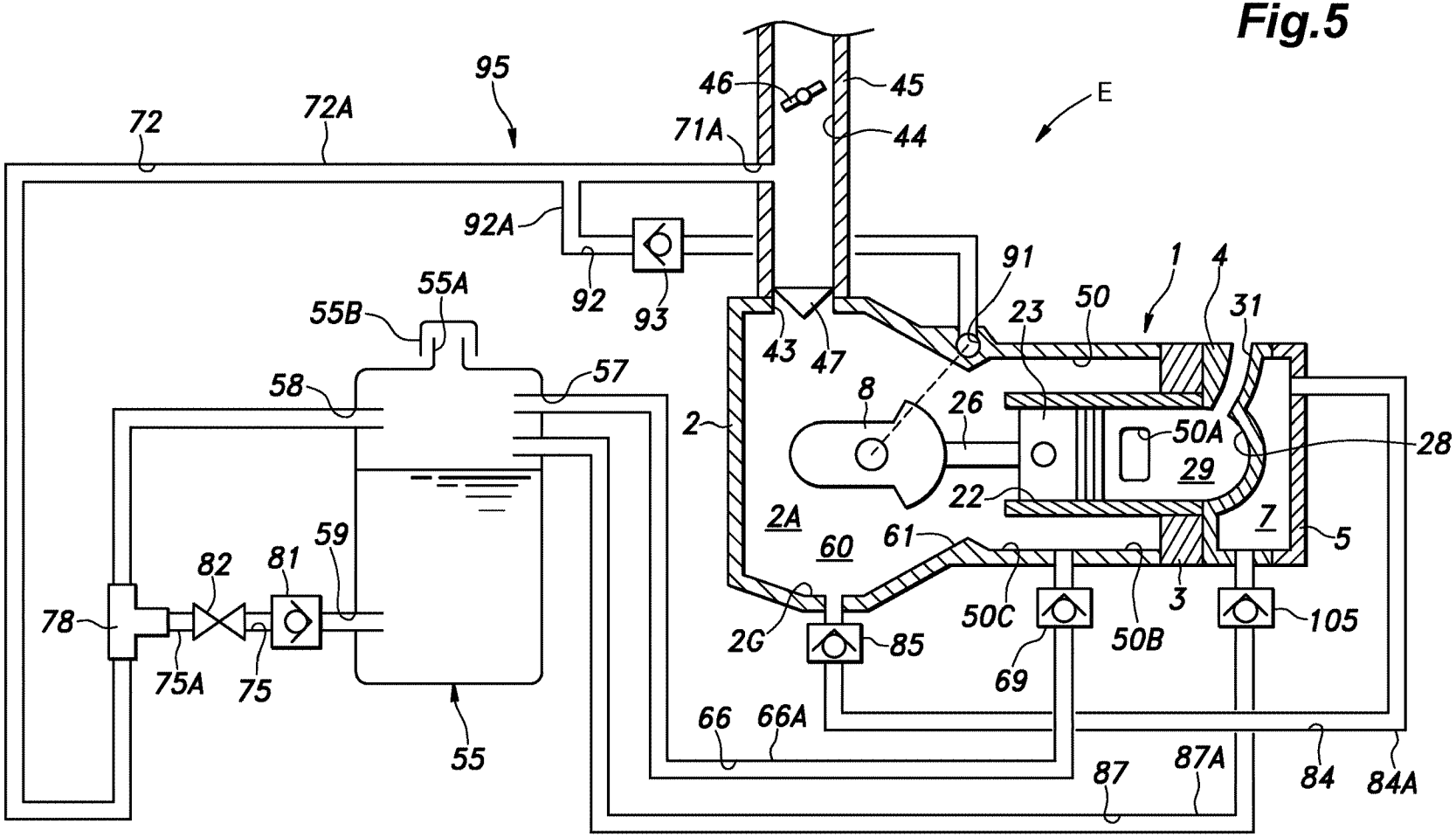
FIG. 5 is a diagram similar to FIG. 3 showing another modified embodiment of the lubrication system.

The present invention has been described in terms of a concrete embodiment, but the present invention is not limited by this embodiment, and can be modified in various ways without departing from the spirit of the present invention. For instance, as shown in FIG. 4, the seventh passage 92 may be connected to the fifth passage 87, instead of the second passage 72. As shown in FIG. 5, the fifth passage 87 may be connected to the oil tank 55, instead of the intake passage 44. In this case, the fifth passage 87 may be provided with a seventh check valve 105 that permits the flow from the valve actuation chamber 7 to the oil tank 55, but prevents the flow in the opposite direction.

Figure 6:
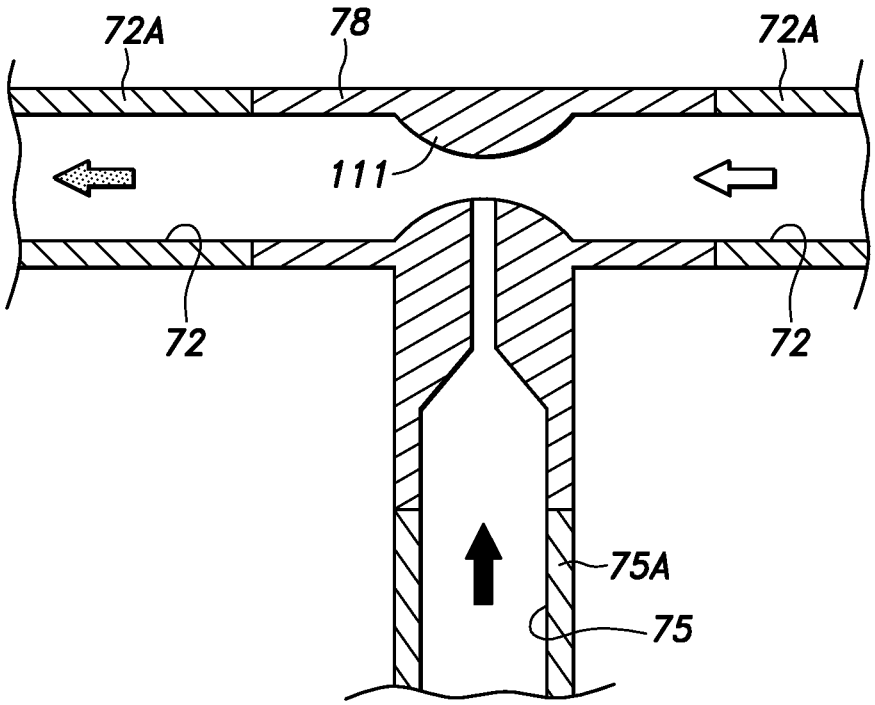
FIG. 6 is a simplified sectional view showing the connecting part between the second passage and the third passage in another modified embodiment of the lubrication system.
Figure 7:
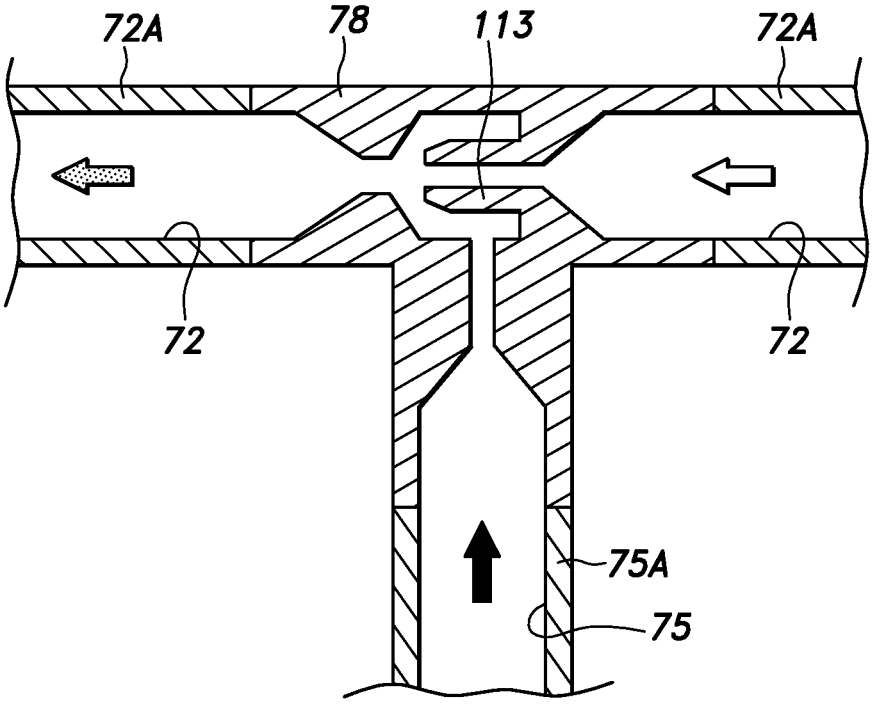
FIG. 7 is a view similar to FIG. 6 showing another modified embodiment of the lubrication system.

Preferably, as shown in FIG. 6, the connecting part 78 may be provided with a flow restriction 111 or a venturi which narrows the cross sectional area of the second passage 72, and the corresponding end of the third passage 75 may be connected to the second passage 72 at this flow restriction 111. In this case, the flow speed of the gas flowing through the flow restriction 111 increases, and the negative pressure produced at the flow restriction 111 draws the lubricating oil from the side of the third passage 75 so that the mixing of the gas with the lubricating oil is enhanced. Also, the connecting part 78 may be formed as an ejector. In this case, as shown in FIG. 7, the connecting part 78 is provided with a nozzle 113 that restricts the cross section of the second passage 72 while the corresponding end of the third passage 75 opens out near the outlet end of the nozzle 113. According to this arrangement, the flow speed of the gas flowing through the nozzle 113 increases, and the negative pressure produced near the outlet end of the nozzle 113 draws the lubricating oil from the side of the third passage 75 so that the mixing of the gas with the lubricating oil is enhanced.

In the illustrated embodiment, the hump 61 was provided between the lower surface of the crankcase chamber 2A and the lower surface of the passage section 50B of the scavenging passage 50. In an alternate embodiment, the lower surface of the passage section 50B is defined by a sloping surface that drops in the rearward direction, instead of providing a hump. According to this arrangement, the liquid lubricating oil that may be deposited on the lower surface of the passage section 50B is caused to flow along the sloping surface rearward under the action of the gravity, and is then collected in bottom part 2G of the crankcase chamber 2A. In this case, the oil return passage 63 may be omitted.

The foregoing embodiment consisted of a two-stroke engine in which the intake is passed through the crankcase chamber 2A, but the present invention is also applicable to other two stroke engines and four stroke engines where the intake is directly supplied to the combustion chamber 29 without passing through the crankcase chamber 2A. The present invention is suited to be applied to engines where a relatively large pressure pulsation occurs in the crankcase chamber 2A, such as single cylinder engines and two cylinder engines with a crankpin phase difference of 360 degrees or 270 degrees. When the intake passage 44 is omitted, the second passage 72 is directly connected to the crankcase chamber 2A, and is provided with a check valve that permits the flow from the oil tank 55 to the crankcase chamber 2A but not in the opposite direction.

The invention claimed is:

1. An internal combustion engine, wherein a pressure in an internal space including a crankcase chamber thereof pulsates owing to a reciprocating movement of a piston in a cylinder, the internal combustion engine comprising:

an oil tank separated from the internal space and configured to store lubricating oil therein;

a first passage communicating a vertically lower part of the internal space with a gas phase part of the oil tank;

a first check valve provided in the first passage to permit a flow from the internal space to the oil tank but not in a reverse direction;

a second passage connected with the gas phase part of the oil tank;

an intake passage connecting the internal space with the second passage;

a second check valve provided in the intake passage to permit a flow from the second passage to the internal space but not in a reverse direction;

a third passage communicating a liquid phase part of the oil tank with the second passage;

a third check valve provided in the third passage to permit a flow from the oil tank to the second passage but not in a reverse direction; and a flow regulator valve provided in a part of the third passage located between the third check valve and the second passage for regulating a flow of lubricating oil flowing through the third passage.

2. The internal combustion engine according to claim 1, further comprising:

a valve actuation chamber accommodating a valve actuation mechanism for actuating an exhaust valve provided in an exhaust passage communicating with the cylinder;

a fourth passage communicating a vertically lower part of the internal space with the valve actuation chamber;

a fourth check valve provided in the fourth passage to permit a flow from the internal space to the valve actuation chamber but not in a reverse direction;

a fifth passage communicating the valve actuating chamber with the internal space or the oil tank; and a fifth check valve provided in the fifth passage to permit a flow from the fifth passage to the internal space or the oil tank but not in a reverse direction.

3. The internal combustion engine according to claim 2, wherein a connecting part between the fourth passage and the internal space is positioned lower than a connecting part between the first passage and the internal space.

4. The internal combustion engine according to claim 3, wherein the internal combustion engine consists of a two stroke engine, and is provided with a scavenging passage selectively communicating the internal space with a side part of the cylinder depending on a position of the piston; and wherein the second passage and the fifth passage are connected to the internal space via the intake passage, and the second check valve and the fifth check valve consist of a common check valve provided in the intake passage.

5. The internal combustion engine according to claim 4, further comprising a throttle valve provided upstream of a part of the intake passage where the second passage and the fifth passage are connected thereto.

6. The internal combustion engine according to claim 4, further comprising:

a crankshaft disposed in the internal space and rotatably supported by a main body of the internal combustion engine;

a sixth passage formed in the main body and extending to a sliding part of the crankshaft;

a seventh passage communicating the sixth passage with the fifth passage or with a part of the second passage located between the internal space and a connecting part between the second passage and the third passage; and a sixth check valve provided in the seventh passage to permit a flow to the sixth passage but not in a reverse direction.

7. The internal combustion engine according to claim 4, further comprising a fuel injection valve for injecting fuel into the scavenging passage.

8. The internal combustion engine according to claim 1, wherein the engine consists of a horizontal engine having a cylinder axial line oriented in a substantially horizontal direction.

* * * * *